United States Patent [19]

Mingledorff, Jr.

[11] Patent Number: 5,037,046

[45] Date of Patent: Aug. 6, 1991

[54] ADJUSTABLE BABY BOTTLE HOLDER

[75] Inventor: Frank C. Mingledorff, Jr., Canton, Ga.

[73] Assignee: Busy Bottle, Inc., Canton, Ga.

[21] Appl. No.: 574,120

[22] Filed: Aug. 29, 1990

[51] Int. Cl.[5] ..... A47D 15/00

[52] U.S. Cl. ..... 248/106; 248/141

[58] Field of Search ..... 248/102, 103, 104, 105, 248/106, 107, 900, 130, 133, 136, 137, 139, 141, 311.3; 211/182

[56] References Cited

U.S. PATENT DOCUMENTS

| | | | |
|---|---|---|---|
| 743,914 | 11/1903 | McMurran | 248/107 X |
| 1,084,427 | 1/1914 | Hanks | 248/103 |
| 2,261,604 | 11/1941 | Seitz | 248/107 |
| 2,638,296 | 5/1953 | Battle | 248/105 |
| 2,717,753 | 9/1955 | Schweikert | 248/106 |
| 2,755,051 | 7/1956 | Cook | 248/311.3 X |
| 2,881,999 | 4/1959 | Mitchell | 248/106 |
| 2,929,290 | 3/1960 | Smith | 248/105 X |
| 3,222,020 | 12/1965 | Rea | 248/106 |
| 4,125,244 | 11/1978 | Lukey | 248/900 X |
| 4,218,036 | 8/1980 | Pitkanen | 248/900 X |
| 4,561,549 | 12/1985 | Yokohori | 211/182 X |

*Primary Examiner*—J. Franklin Foss

*Attorney, Agent, or Firm*—N. J. Aquilano

[57] ABSTRACT

A support for holding a baby bottle in a feeding position including a frustro conical bottle holder and adjustable support arms and legs permitting adjustable positioning of the holder. Rachet type adjustment means include relatively rotatable members having detents and recesses which connect the moveable parts permitting adjustment therebetween.

8 Claims, 2 Drawing Sheets

ADJUSTABLE BABY BOTTLE HOLDER

BACKGROUND AND SUMMARY OF THE INVENTION

The present invention relates to baby bottle supports, and in particular to a baby bottle support which is universally adjustable to maintain a baby bottle in a feeding position.

It has been well recognized that infants and babies have difficulty in feeding from a baby bottle because of their inability to maintain the bottle in a feeding position whereby milk or other liquid is fed by gravity into the infant's mouth.

Numerous prior art devices are available for holding bottles including those shown in U.S. Pat. No. 2,755,051 to Cook, U.S. Pat. No. 2,953,337 to Valis, U.S. Pat. No. 3,082,985 to Herdman, U.S. Pat. No. 3,184,193 to Malvin and U.S. Pat. No. 4,014,505 to Dowd among many others.

The present invention relates to a baby bottle holder which is universally adjustable using a unique leg support structure combined with a universally adjustable ratchet joint.

The bottle support is adaptable for use on a variety of support surfaces including a crib, playpen, baby seat or the like.

Among the objects of the present invention is the provision of an improved supporting device for holding a baby bottle in a feeding position permitting gravity feed of the liquid.

Another object is the provision of a baby bottle supporting device which is durable in construction, is made with inexpensive components and which may be readily collapsed for transportation or storage.

A further object is the provision of a bottle support device which permits inspection of the contents of the bottle while the bottle is being supported.

The support member itself includes a hollow, cylindrical, frustro-conical member, having a larger and smaller end opening to frictionally engage and support a bottle inserted into the larger opening therein while permitting the cap and nipple portion of the bottle to extend through the smaller opening beyond the holder to facilitate feeding. The leg supports include an upper leg section, arcuate in shape, attached directly to the holder by a universal ratchet joint and horizontal foot members, elongated and spaced apart from the holder, thereby permitting stable placement of the bottle support in a feeding location.

Other objects and advantages of the invention will become apparent with reference to the following specification and the drawings.

DESCRIPTION OF THE PREFERRED EMBODIMENTS

Figure 1:
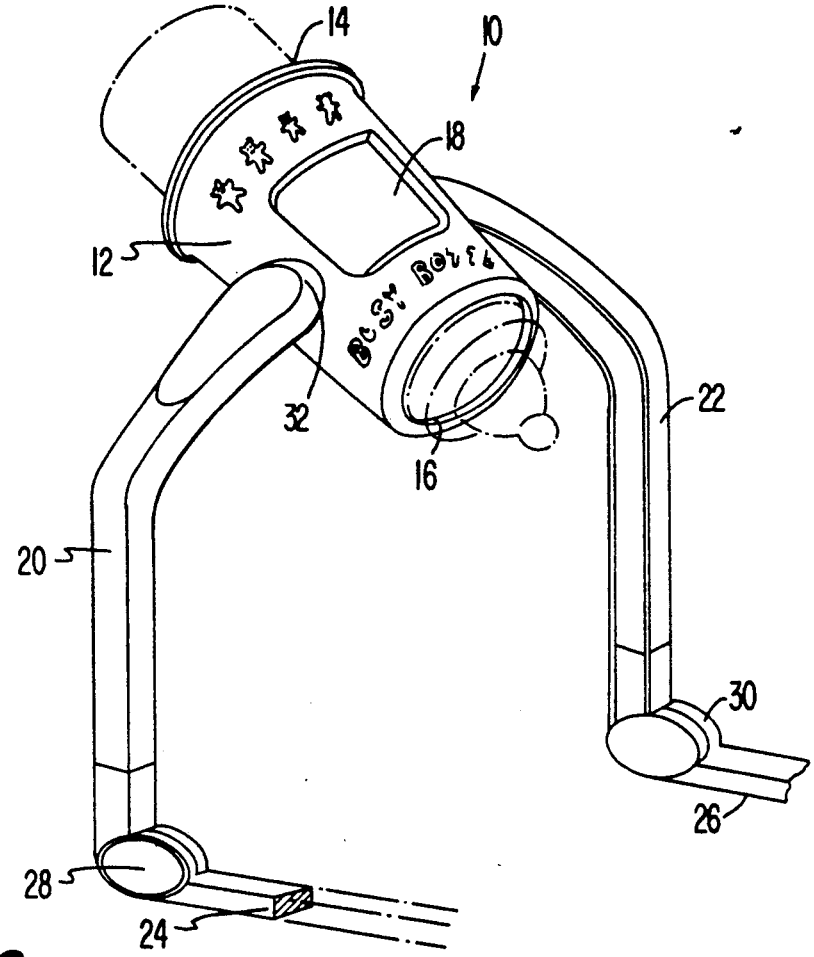
FIG. 1 is a perspective view of the adjustable baby bottle holder of the present invention.
Figure 2:
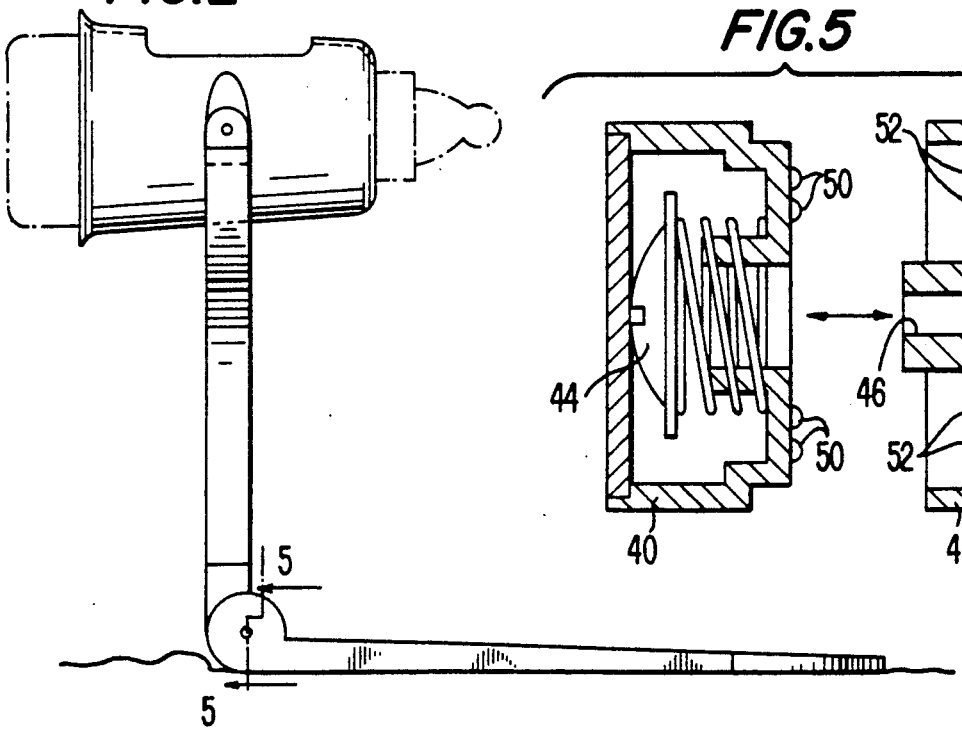
FIG. 2 is a side elevational view with the bottle holder and the leg members at 90 degrees with respect to each other.

Referring to the drawings, the baby bottle holder 10 of the present invention is formed of a tapered cylindrical holder 12 open at either end, and sized to receive and hold a conventional size baby bottle. One end of the holder 12 is provided with a large opening 14 into which the bottle is inserted, and the opposite end of the holder 12 is provided with a smaller opening 16 structured and sized to permit the nipple and cap portion of the bottle to pass through while abutting the top of the bottle to maintain it in position when the holder is tilted downwardly toward a feeding baby, as shown in FIG. 1. The holder 12 includes a window 18 which permits the monitoring of the contents of the bottle while the baby is feeding.

The holder 12 is adjustably positioned using a pair of legs including upright leg members 20 and 22 and horizontal support feet 24 and 26 movably attached to the leg members 20 and 22 by universally adjustable ratchet joints 28 and 30 located between the upright and the horizontal members respectively. The upright leg members 20 and 22 are adjustably supported on the cylindrical holder 12 using a second pair of universally adjustable ratchet joints 32 and 34. It will be appreciated that the ratchet joints permit the feet and leg members to be fully adjustable within a 180 degree range, and also permit the cylindrical holder 12 to be adjustable through a complete 360 degree range, it being further appreciated that the bottle preferably would be positioned to allow gravitational flow of the liquid therefrom during the feeding process.

Figure 5:
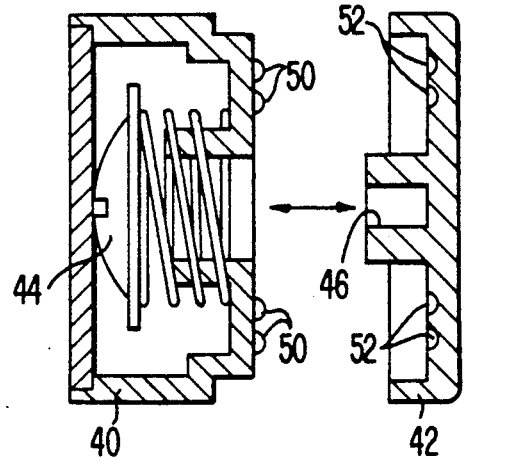
FIG. 5 is a sectional view of the ratchet joint, partly in section, taken along the lines 5—5 of FIG. 2.
Figure 3:
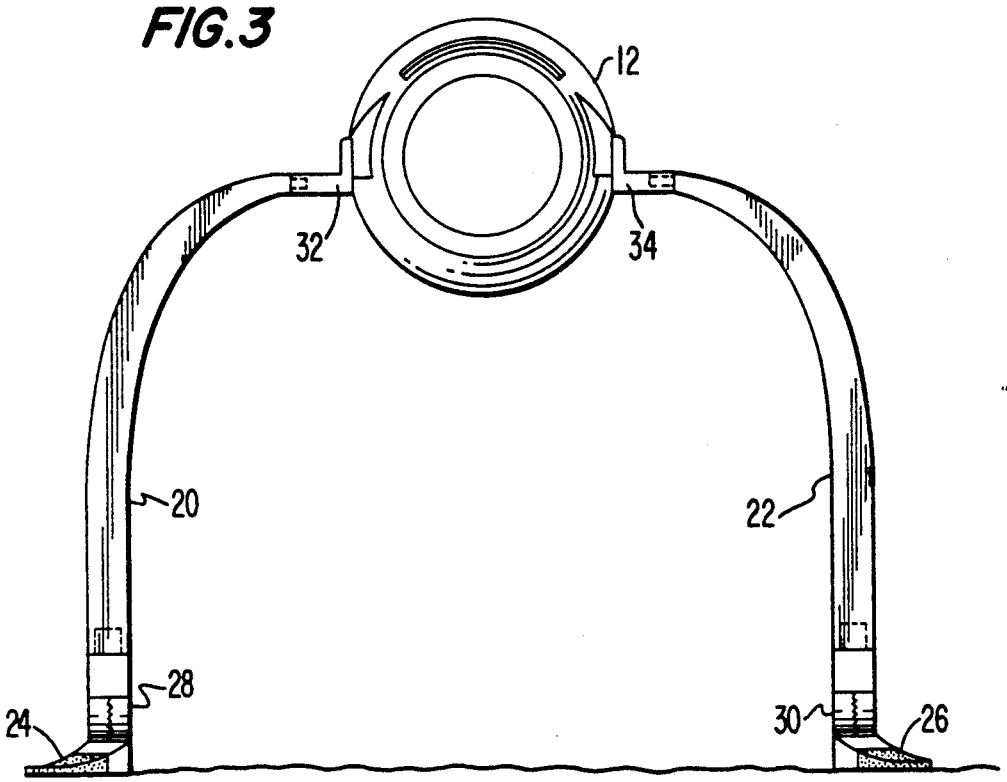
FIG. 3 is a front elevational view thereof.
Figure 4:
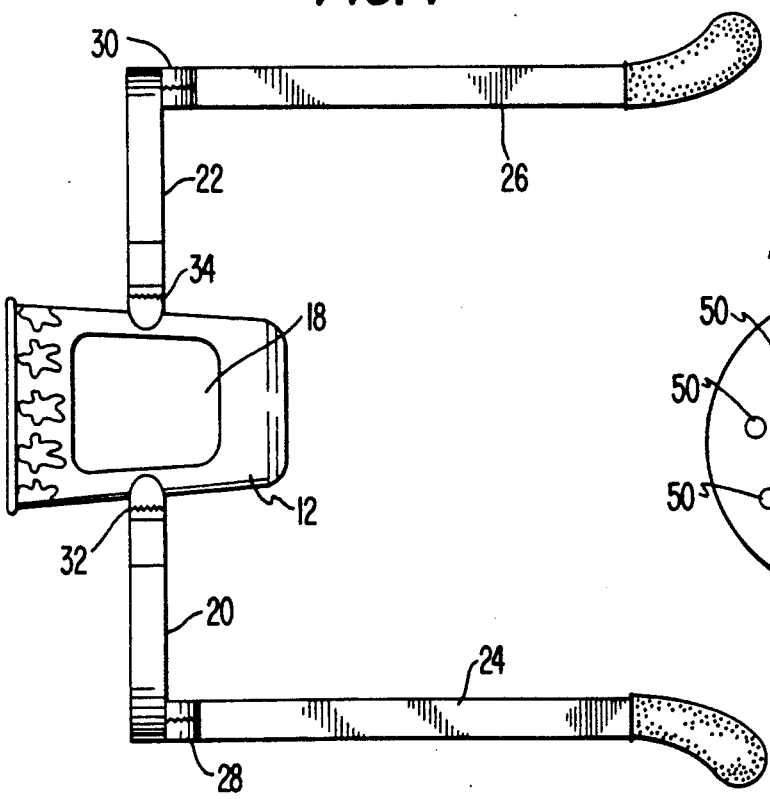
FIG. 4 is a top plan view thereof.
Figure 6:
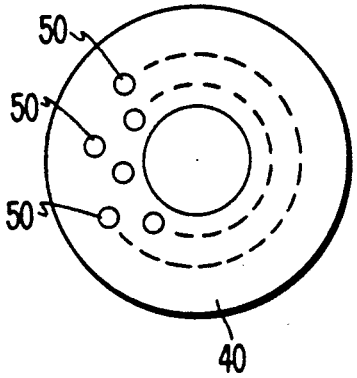
FIG. 6 is a view of the face of the ratchet joint of FIG. 5.

Referring to FIGS. 5 and 6, the ratchet joints are shown in detail. Each rachet joint is formed of a pair of circular hub members 40 and 42 centrally mounted to each other using a screw 44 which engages a nut (not shown) or other fastener in a bore 46 in member 42. The hub members 40 and 42 are resiliently biased together by means of a spring 48.

The face of hub member 40, see FIG. 6, is provided with a circumferential array of detents 50 which fit into a similar array of recesses 52 in hub member 42. The detents 50 and recesses 52 are arranged to cooperate with each other so as to be adjustable to lock the hub members 40 and 42 in a non-rotational, pre-selected position in a full 360 degree range using the biasing action of the spring 48.

In use, the ratchet joints are adjustable by simply pulling the hub members apart against the force of the spring 48 which permits their free rotational movement relative to each other. When a desired position is reached, the tension spring is allowed to pull the hub members back to a coupled position causing the detent members to engage to prevent relative rotation between them.

The elongated horizontal foot members 24 and 26 allow the bottle holder to be free-standing and self-supporting even on marginally supportive surfaces such as a baby crib, play pen, car seat or the like.

It will be appreciated that the above description is illustrative only and that many modifications can be made in keeping within the scope of the following claims.

I claim:

1. A support for supporting a fluid filled container in a dispensing position comprising:

a frustro conical container holder having a first opening on one end thereof to permit insertion of said container therein and a second smaller opening on the opposite end thereof permitting a dispensing means on said container to extend through said second smaller opening;

a pair of support arms adjustably attached approximately midway on outer wall surfaces of said holder between said first and second openings, one each of said pair of support arms being located on opposite sides of said holder; said pair of support arms being disposed in a vertical direction for supporting said holder above a ground support surface;

a pair of support legs adjustably connected to said support arms and being disposed in a horizontal direction for engagement with said ground support surface;

multiple adjustment means including first adjustment means connected between said holder and said support arms; and second adjustment means connected between said support arms and said support legs; said multiple adjustment means permitting adjustment of said holder and a container supported therein in a dispensing position relative to said ground support surface.

2. The support of claim 1 wherein said first and second adjustment means each include adjustable locking means having a plurality of locking positions permitting multiple adjustment of said support arms and said support legs relative to each other and multiple adjustment of said support arms and said holder relative to each other.

3. The support of claim 2 wherein said locking means is a ratchet member pair having including other opposing, cooperating ratchet plates rotatable each with the other.

4. The support of claim 3 wherein said ratchet plates further include a plurality of detents on one of said plates and a plurality of recesses on the other of said plates.

5. The support of claim 4 wherein said ratchet plates include spring biasing means to maintain said plates locked in a preselected locking position.

6. The support of claim 1 wherein said holder includes an inspection window located approximately midway between said first and second openings to permit inspection of the contents of said container.

7. A support for supporting a fluid filled container in a dispensing position comprising:

a frustro conical container holder having a first opening on one end thereof to permit insertion of said container therein and a second smaller opening on the opposite end thereof permitting a dispensing means on said container to extend through said second small opening;

a pair of support arms adjustably attached approximately midway on outer wall surfaces between said first and second openings of said holder, one each of said pair of support arms being located on opposite sides of said holder, said pair of support arms being disposed in a vertical direction for supporting said holder above a ground support surface;

a pair of support legs adjustably connected to said support arms and being generally disposed in a horizontal direction with respect to said holder for engagement with said ground support surface;

multiple adjustment means including a first ratchet member pair connected between said holder and said support arms and a second ratchet member pair connected between said support arms and said support legs;

said ratchet member pairs having a plurality of locking positions permitting adjustment of said support arms and said support legs relative to each other and adjustment of said support arms and said holder relative to each other for adjusting said holder and a container supported therein in a dispensing position relative to said ground support surface.

8. A support of claim 7 wherein said ratchet member pair include oppositely disposed cooperating ratchet plates having a plurality of detents in one of said plates and a plurality of recesses on the opposite of said plates and further including spring biasing means to maintain said plates defining said locking positions locked in a preselected locking position relative to each other.

* * * * *